US005927618A

United States Patent [19]

Jefferies et al.

[11] Patent Number: 5,927,618

[45] Date of Patent: Jul. 27, 1999

[54] ELECTROSTATIC SPRAYING DEVICE

[75] Inventors: Andrew Jefferies, Pantymwyn; Maurice Joseph Prendergast, Runcorn; Michael Leslie Green, Nanerch; Timothy James Noakes, Pantymwyn, all of United Kingdom

[73] Assignee: The Procter & Gamble Company, Cincinnati, Ohio

[21] Appl. No.: 08/592,418

[22] PCT Filed: Aug. 22, 1994

[86] PCT No.: PCT/GB94/01829

§ 371 Date: Feb. 6, 1996

§ 102(e) Date: Feb. 6, 1996

[87] PCT Pub. No.: WO95/06521

PCT Pub. Date: Mar. 9, 1995

[30] Foreign Application Priority Data

| | | | |
|---|---|---|---|
| Sep. 2, 1993 | [GB] | United Kingdom | 9318175 |
| Sep. 2, 1993 | [GB] | United Kingdom | 9318176 |
| Sep. 2, 1993 | [GB] | United Kingdom | 9318199 |

[51] Int. Cl.[6] ..... B05B 5/025

[52] U.S. Cl. ..... 239/690.1; 239/44; 239/49

[58] Field of Search ..... 239/690, 690.1, 239/3, 34, 44, 145, 326, 704, 708, 49

[56] References Cited

U.S. PATENT DOCUMENTS

| | | | |
|---|---|---|---|
| 788,805 | 5/1905 | Walz | 239/49 |
| 1,676,943 | 7/1928 | Dargavel | 239/49 |
| 1,958,406 | 5/1934 | Darrah | 239/1 |
| 4,381,533 | 4/1983 | Coffee | 361/228 |
| 4,431,137 | 2/1984 | Prewett et al. | 239/690 |
| 4,476,515 | 10/1984 | Coffee | 239/3 |
| 4,477,414 | 10/1984 | Muramoto et al. | 239/44 |
| 4,580,721 | 4/1986 | Coffee et al. | 239/3 |
| 4,659,012 | 4/1987 | Coffee | 239/3 |
| 4,776,515 | 10/1988 | Michalchik | 239/3 |
| 4,830,872 | 5/1989 | Grenfell | 239/690 |
| 4,846,407 | 7/1989 | Coffee et al. | 239/690 |
| 4,962,885 | 10/1990 | Coffee | 239/690 |
| 5,176,321 | 1/1993 | Doherty | 239/3 |
| 5,196,171 | 3/1993 | Peltier | 422/121 |
| 5,337,963 | 8/1994 | Noakes | 239/690 |
| 5,487,782 | 1/1996 | Seewaldt | 239/690 |
| 5,503,335 | 4/1996 | Noakes et al. | 239/690 |
| 5,542,605 | 8/1996 | Campau | 239/44 |

FOREIGN PATENT DOCUMENTS

| | | |
|---|---|---|
| A 0 404 344 | 12/1990 | European Pat. Off. . |
| A 0486 198 | 5/1992 | European Pat. Off. . |
| A 0 501 725 | 9/1992 | European Pat. Off. . |
| A 1 084 379 | 1/1955 | France . |
| C 282 864 | 9/1990 | German Dem. Rep. . |
| WO A 85 00761 | 2/1985 | WIPO . |
| WO A 92 15339 | 9/1992 | WIPO . |

*Primary Examiner*—Andres Kashnikow
*Assistant Examiner*—Lisa A. Douglas
*Attorney, Agent, or Firm*—William Scott Andes

[57] ABSTRACT

An electrostatic spraying device is disclosed having a container (16) for the liquid to be sprayed and a capillary structure (22) extending into the container. To maintain a substantially constant liquid level at the location where liquid is drawn into the capillary structure, the container is partitioned into two chambers, one (68) of which is isolated from atmosphere and the other (66) of which is in communication with atmosphere. The capillary structure (22) extends through one chamber and the arrangement is such that the liquid level at the location where the capillary structure communicates with the liquid is maintained substantially constant over a wide range of variation of the liquid level within the other chamber. The upper end of the capillary structure may be provided with an oblique end face (50; 70, 72) to facilitate dispersal of the spray into the surroundings.

11 Claims, 2 Drawing Sheets

ELECTROSTATIC SPRAYING DEVICE

This invention relates to the electrostatic spraying of liquids, especially devices for spraying liquids into the surroundings, for example in situations where the liquid is intended to impart or absorb an aroma or is intended for use in precipitating dust particles or the like from the surroundings.

One such device is disclosed in our prior PCT/GB 92/01712 which discloses the use of a capillary structure composed of foam material for effecting capillary transport of liquid from a reservoir housed within the device to a spraying tip at which the liquid is drawn by the electric field prevailing between the spraying tip and the surroundings into ligaments which then break up into electrically charged droplets to form the spray. Other such devices are known from our prior EP-A-486198 and EP-A-120633.

A problem encountered with such devices is that of securing a reasonably reliable rate of flow of liquid via the capillary structure to the spraying tip since the delivery rate is dependent, inter alia, on the liquid level within the reservoir. If the capillary structure is in the form of a tube, for example as disclosed in EP-A-486198, the larger the diameter of the capillary tube, the more sensitive the device tends to be to variations in the liquid level within the reservoir with the consequence that the quality of spray produced by the device can vary substantially as the liquid level within the reservoir falls.

In PCT/GB 92/01712 and EP-A-486198, the problem is tackled by employing a liquid reservoir which is in the form of a container having a squat configuration. However, the use of a container with such a configuration tends to impose constraints on the design of the device.

The present invention is concerned with improvements in devices of the kind disclosed in the aforementioned prior patent publications.

According to one aspect of the present invention there is provided an electrostatic spraying device, comprising a container for liquid to be electrostatically sprayed, a capillary feed structure having one end thereof located within the container and an opposite end thereof forming and or associated with a spraying tip of the device in use, and means for controlling liquid level within the container.

According to a second aspect of the present invention there is provided an electrostatic spraying device, comprising a container for liquid to be electrostatically sprayed, a capillary feed structure having one end thereof located within the container and an opposite end thereof forming and or associated with a spraying tip of the device in use, and means for controlling liquid level within the container so that, at the location at which the capillary structure enters the liquid, the liquid level remains substantially constant at least while the volume of liquid within the container is within predetermined limits.

The container, the capillary structure and said means are advantageously embodied within a replaceable cartridge.

Preferably said liquid level is substantially unaffected at least until the amount of liquid within the container falls below 40%, more preferably below 30% and most preferably below 20% of the designed liquid holding capacity of the container. In practice, the invention permits said liquid level to be maintained substantially constant until the container is near empty.

In one embodiment of the invention, said means comprises a partition which, in conjunction with liquid within the container, separates the interior of the container into two chambers, a first chamber which is substantially isolated from the exterior of the container, and a second chamber which is in communication with the exterior of the container, the capillary structure being arranged to extend through the second chamber whereby liquid is fed by the capillary structure from the base of the second chamber to the spraying tip. The partition is conveniently of tubular configuration with the first chamber being of generally annular configuration and the second chamber being defined by the tubular partition.

Apart from the form of the container, a device in accordance with the invention may otherwise be substantially the same as the devices disclosed in our prior EP-A-468198, the entire disclosure of which is incorporated herein by this reference.

The capillary structure may be in the form of a wicking material or it may be in the form of a tube. In the latter case, the device is preferably constructed and arranged to operate in such a way the liquid is drawn across the end face at the spraying tip and is projected electrostatically as one or more ligaments from the tube, which ligaments thereafter break up to form the spray.

Usually the liquid will be projected from the spraying tip as an array of ligaments extending from locations at or immediately adjacent the edge at which the tube end face intersects the outer peripheral surface of the tube, the ligaments being spaced from one another in the peripheral direction. By spraying the liquid in the form of an array of ligaments, it is possible to secure a spray comprising smaller diameter droplets than is possible if the liquid is sprayed as a single ligament.

In order to improve dispersion of the spray into the surroundings and reduce the tendency for droplets to deposit on surfaces in the immediate vicinity of the device, said opposite end of the capillary structure is preferably of asymmetric configuration such that spraying of liquid from one side of the structure is favoured. In this way, it is possible to ensure that the spray is projected more effectively in a vertical upwards direction thereby improving dispersion.

According to a further aspect of the invention there is provided in or for an electrostatic spraying device, a cartridge comprising a container for the storage of liquid to be sprayed, and a capillary tube having one end thereof located within the container and an opposite end thereof forming a spraying tip of the device in use, characterised in that said opposite end of the capillary tube is of asymmetric configuration such that spraying of liquid from one side of the tube is favoured.

Preferably the end face at said opposite end of the capillary tube extends obliquely between diametrically opposite sides of the tube so as to impart to the tube an asymmetric configuration such that the tube has a leading extremity at one side thereof from which spraying is favoured.

Usually the leading extremity will have an angle substantially less than 90°, typically within the range 30 to 60° (eg 40 to 50°), so as to intensify the electric field in the region of the favoured spraying site.

In a specific embodiment, an electrostatic spraying device comprises a spraying tip, a reservoir for containing liquid to be supplied to the spraying tip, a capillary tube having one end thereof located within the reservoir and the other end thereof forming the spraying tip, and means for applying high voltage to the liquid so that liquid discharged from the spraying tip is atomised under the influence of the electric field, the capillary tube, the reservoir and the voltage applying means being embodied in a housing which is adapted for stable location in a position in which the capillary tube points upwardly and feed of liquid from the reservoir to the spraying tip is provided by capillary action.

Preferably the capillary tube is fabricated from non-metallic material and application of voltage to the liquid emerging at the tip of the tube is achieved through the agency of the liquid contained in the capillary tube by connecting the voltage applying means to the body of liquid in the reservoir. In this manner, risk of shock to a user is reduced since the capillary tube is not metallic and the column of liquid within the capillary tube serves to provide shock suppressing electrical resistance. Also it is not envisaged as being necessary to incorporate within the device a field adjusting electrode in close proximity with the spraying tip.

Usually the liquid will be projected from the spraying tip as an array of ligaments extending from locations at or immediately adjacent the edge at which the tube end face intersects the outer peripheral surface of the tube, the ligaments being spaced from one another in the peripheral direction and being collectively confined to part only of the peripheral extent of said edge, ie that part which includes said leading extremity.

The capillary tube, which may (but need not necessarily) be one having a substantially circular section at its inner and/or outer peripheries, is usually composed of a non-metallic material, especially a polymeric material having suitable wetting properties relative to the liquid to be sprayed whereby adequate capillary rise can be secured.

The capillary tube may be one which has a smooth outer peripheral surface. In use of the device, the capillary tube is preferably located so that liquid ligament projection from the spraying tip is at least predominantly vertically upwardly directed. In some instances, to achieve highly efficient dispersal of the sprayed droplets into the surroundings with minimal risk of deposition on surfaces immediately surrounding the device, especially when the latter is designed for use on a horizontal surface such as a table top or shelf, it may be desirable to orientate the capillary tube with its longitudinal axis inclined obliquely to the vertical so that ligament projection is in a substantially vertical direction.

For ease of fabrication, in one embodiment of the invention the obliquely extending end face of the capillary tube may be substantially planar.

In another embodiment, the end face has a more complex configuration comprising a first planar surface intersecting a second planar surface, with the line of intersection between the two planes located to one side of the capillary tube and preferably radially outwardly of the capillary bore. The latter embodiment is particularly suitable where the wall thickness of the capillary tube is relatively large. In this case, if the end face comprises a single obliquely extending surface, the distance that the liquid has to travel across the end face from the capillary bore to the spraying edge formed by the intersection between the end face and the outer peripheral surface of the capillary tube may be relatively large with the risk that adequate supply of liquid to the spraying edge may not be achieved. In this event, spraying efficiency may be affected. By configuring the end face so that the spraying edge is defined by intersecting obliquely extending surfaces, the distance to be travelled by the liquid can be reduced.

As in EP-A-486198, a feature of devices in accordance with the present invention is that the spraying tip is arranged to spray generally vertically upwards without requiring a positive head, ie. it is not necessary for the spraying tip to be located at a lower level than the liquid level within the cartridge or reservoir.

The device may be adapted to be placed on a horizontal surface in which case it may have a flat base or have formations for contact with a horizontal surface so that the device is orientated in such a way that, with the cartridge inserted therein, the capillary structure is located generally vertically with its spraying tip uppermost. Alternatively, or additionally, the device may be intended to be suspended from a generally vertical surface such as a wall in which case it will be provided with a suspension means so arranged that the device will be appropriately oriented in use. For example, the device housing may include a wall contacting surface which, in conjunction with the suspension means, ensures that the capillary structure is appropriately oriented when the housing is mounted on the wall.

Typically, suitable liquids to be sprayed will have a bulk resistivity of the order of $10^4$ to $5\times10^7$ ohm cm.

In the case of a capillary structure in the form of a tube, preferably the wall thickness of the tube at the tip is selected so that the radial distance between the meniscus of the liquid in the tube and the outer peripheral edge of the tube is short whereby a steep potential gradient is produced across the wall thickness, this being important to ensure that the liquid is drawn from the meniscus across the end surface at the tip and towards that part of the peripheral edge of the spraying tip from where the liquid issues. A potential gradient is believed to exist between these points in operation because of the tendency for corona to occur at acute angled leading extremity of the tube which results in a lower potential at this point compared with the potential existing at the liquid meniscus. Typically the wall thickness of the tube at the tip is no greater than 1 mm, and preferably no greater than about 500–600 microns. Often the wall thickness at the tip is no greater than 400 microns, more preferably no greater than about 250 to 300 microns, and may be less than about 100 to 150 microns. Thus, the capillary tube preferably has an edge or a sufficiently sharply radiussed formation so that, at the designed operating voltage of the device (typically in the range 5 kV to 15 kV), some degree of corona discharge is generated to develop the previously mentioned potential gradient.

As mentioned previously, small droplet sizes can be achieved if the liquid emerging at the spraying tip is discharged as a plurality of jets or ligaments. This can be achieved by selecting the wall thickness of the tube at the tip such that the potential gradient at said leading extremity of the tube is sufficiently high to secure multi-jet spraying as opposed to single jet spraying.

The capillary tube should desirably extend upwardly from a position at or near the bottom of the cartridge in order that substantially the entire liquid content of the cartridge can be emptied from the cartridge by electrostatic spraying.

One problem associated with an electrostatic spraying device which utilises a capillary tube is that of optimising the capillary tube with respect to factors such as capillary rise, field intensification and liquid delivery rate to the spraying tip.

According to another aspect of the present invention there is provided an electrostatic spraying device comprising a spraying tip, a reservoir for containing liquid to be supplied to the spraying tip, a capillary tube having one end thereof located within the reservoir and the other end thereof forming the spraying tip, and means for applying high voltage to the liquid so that liquid discharged from the spraying tip is atomised under the influence of the electric field, the capillary tube, the reservoir and the voltage applying means being embodied in a housing which is adapted for stable location in a position in which the capillary tube points upwardly and feed of liquid from the reservoir to the spraying tip is provided by capillary action, characterised in that the capillary tube comprises a first capillary portion extending from said one end followed by a second capillary portion terminating at or adjacent said opposite end of the capillary tube, the second portion having a bore of smaller cross-sectional area than that of the first portion.

Capillary tube diameter is an important factor in electric field intensification at the spraying tip; other factors being equal, the narrower the tube outside diameter at the spraying tip the greater the electric field gradient in the vicinity of the tip. However, a narrower diameter tube presents greater hydraulic resistance to liquid flow than larger diameter tubes and consequently enhanced field intensification is offset by a reduction in the delivery rate of liquid to the spraying tip compared to a larger diameter capillary tube.

The use of a capillary tube comprising portions having different cross-sectional areas facilitates optimisation of the tube according to needs. In particular, the present invention allows enhanced field intensification to be secured without markedly affecting delivery rate, enhanced field intensification being achievable by virtue of said second portion and lower hydraulic resistance being achievable by virtue of said first portion. Moreover, the second portion permits the liquid delivery rate to be fine tuned by appropriate selection of the bore cross-sectional dimension and/or selection of the length of the bore thereof.

Typically the first portion of the capillary tube has an outside diameter of 400 to 800 microns and an inside diameter of 200 to 300 microns. The second capillary portion will usually be dimensioned so that the flow rate to the spraying tip results in an average spraying rate of no greater than 0.1 cc/min, more usually no greater than 0.01 cc/min and preferably within the range 0.0001 to 0.01 cc/min. Typically the second capillary portion has an outside diameter of 200 to 400 microns and an inside diameter of 50 to 100 microns.

The first and second capillary portions are preferably integrally formed with each other. A convenient way of effecting this is by causing a capillary tube of uniform section to neck down to produce a first portion having the same dimensions as the uniform section and a necked down portion constituting the second capillary portion. Such deformation can be readily effected where the capillary tube is of a plastics material such as nylon, ie by exerting a pulling action on one end of the tube, which results in the end portion necking down. The necked down end portion may then be cut or otherwise treated to achieve the asymmetric configuration previously referred to.

A spraying device in accordance with the last defined aspect of the invention may also embody features according to the previously defined aspects of the invention.

The invention will now be described by way of example with reference to the accompanying drawings, in which.

Figure 1:
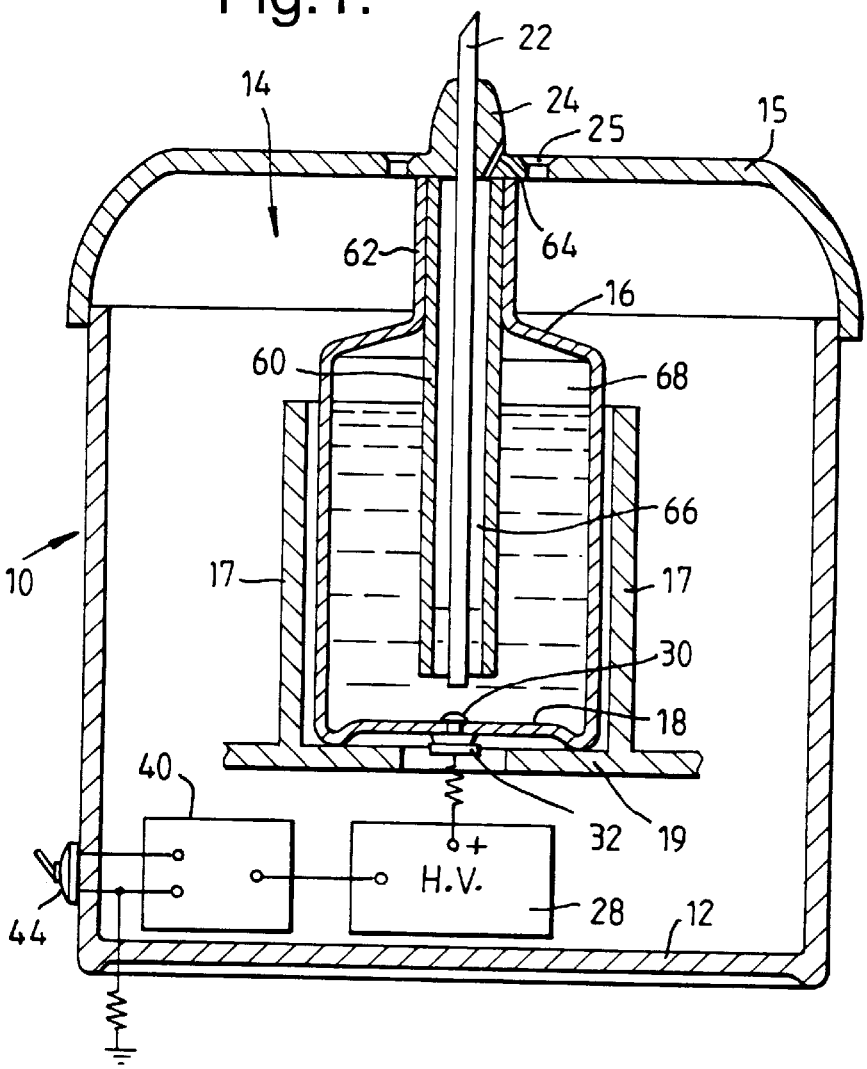
FIG. 1 is a schematic view of an electrostatic air freshener device in accordance with the invention.

Referring to FIG. 1, the air freshener device comprises a housing 10, the bottom wall 12 of which is intended in use to be supported on a generally horizontal surface such as a table top, a shelf or the like. The housing 10 is provided with a compartment 14 to which access can be gained by removal of cover 15 so that a cartridge 16 containing the liquid to be sprayed can be inserted into the compartment. The liquid is one suitable for electrostatic spraying and is selected to have the characteristics appropriate for the intended use of the device, ie. in this case, the liquid will have aromatic properties. As in our prior EP-A-486198, the cartridge 16 may be of squat parallelepiped configuration; however, as described further below the configuration of the cartridge is less important when the cartridge is provided with liquid level controlling means in accordance with the present invention and, as shown in the drawing, the cartridge may be in the form of a vertically elongated container which tends to impose fewer constraints on the overall design of the device. The cartridge 16 is received within a compartment defined by side walls 17 and bottom wall 19. A capillary structure 22 which may be in the form of a tube (but may alternatively be a wicking material such as a foam material as disclosed in PCT/GB 92/01712 or a fibrous or plastics material as disclosed in EP-A-120633) is mounted within the cartridge so as to be generally vertical (ie. generally perpendicular to the horizontal bottom wall 18 of the cartridge) and its lower end is located close to the bottom wall 18 to allow liquid supply to the tube 22 to be maintained as the liquid level approaches the bottom wall 18. The upper end of the capillary tube 22 projects through a cap 24 of the cartridge and through an aperture 25 in the cover 15.

The cartridge 16 is adapted to provide for the connection of the liquid therein to the high voltage output of a high tension generator 28. The connection may be achieved in various ways as discussed in EP-A-486198; in the illustrated embodiment, the cartridge is formed from an electrically insulating material such as nylon and is provided with an electrical contact 30. The contact 30 is located so that, when the cartridge is correctly inserted into the compartment bounded by walls 17, the contact 30 registers with a terminal 32 connected to the high voltage output of the generator 28.

The low voltage side of the generator 28 is connected to a low voltage circuit 40 including one or more batteries (typically 9 volts) and can be switched on or off by means of a user operable switch 44. The generator 28 produces a low current, high voltage output which is typically of the order of 5 to 15 kV and in use this voltage is applied to the liquid contents of the cartridge 16 to effect electrostatic spraying of the liquid from the tube 22. The low voltage circuit 40 may be arranged to control the generator and thereby control spraying according to requirements. The low voltage circuit has a connection to earth through the bottom wall 12 of the housing.

The capillary tube 22 is adapted to provide sufficient capillary rise when disposed vertically to feed liquid from the cartridge to its uppermost tip irrespective of the liquid level within the cartridge. This can be achieved by suitable dimensioning of the capillary tube and selection of the material from which it is fabricated. A suitable material is a polymeric material, such as nylon, polyolefine, polyacetal, polyetheretherketone or PTFE, which is adequately wetted by the formulation to be sprayed, ie. the angle of contact should be substantially zero. The tube 22 in general will have a narrow bore, which may be of round section or otherwise, and a relatively thin wall. However, especially when the cartridge is in a form other than a squat container, and when the tube 22 has a relatively larger diameter, the liquid feed to the spraying tip tends to be sensitive to variations in the liquid level within the cartridge 16 unless other steps are taken, as described hereinafter.

In use, the liquid is fed solely by the capillary action of the tube to the uppermost tip of the tube where it is drawn into ligaments by the high voltage applied to the liquid which issue from the tip of the tube and break up into electrically charged droplets, the droplets being drawn away from the tube tip towards objects and structure in the surroundings which are at earth potential. Typically, the device will be used in a room and the walls, ceiling and floor will therefore provide relatively remote targets towards which the particles are drawn.

The cartridge is provided with means for controlling the liquid level within the container. In particular, the liquid level at the location where the capillary structure enters the liquid is controlled so that the liquid level at this location remains substantially constant at least until the cartridge approaches an empty condition. In the illustrated embodiment, such means is implemented by a tubular partition 60 which is inserted through the mouth 62 of the cartridge 16 as a close fit so as to provide a seal in this region. The tube 60 at its lower end terminates at a location spaced from the bottom wall 18. The tube 60 in conduction with the liquid within the cartridge serves to partition the interior of the cartridge into two chambers, namely the headspace 66 internally of the tube 60 and the headspace 68 external to the tube 60.

The interior of the tube 60 is in communication with atmosphere via a hole 64 formed in the cap 24. In contrast, the headspace 68 (which develops as liquid is drawn from the cartridge by the capillary tube 22) is substantially isolated from atmosphere and tends to be at a lower pressure than the head space 66 within the tube 60. This differential in pressure results in the liquid level surrounding the capillary tube 22 being depressed to a point adjacent the lower end of the partition tube 60. This depression of the liquid level is maintained until the liquid level externally of the tube 60 falls to the level of the lower end of the tube 60. When this occurs, there will be a slight depression in the liquid level around the capillary tube 22 but this variation can be made relatively small by appropriate design of the cartridge, eg by terminating the lower ends of the partition tube 60 and the capillary tube 22 at suitable points.

There will also be a minor fluctuation in the liquid level during normal operation since liquid withdrawal from the cartridge via the capillary tube 22 tends to be accompanied by bubbling of air around the lower end of the tube 60 from the headspace 66 to the headspace 68. Such bubbling will tend to disturb the liquid level at the lower end of the tube 60 but this does not significantly affect spraying efficiency.

The various components forming the cartridge 16, ie the container, the cap 24, the partition tube 60 and the capillary tube 22 may be fabricated from any suitable non-metallic material, eg a plastics material selected from those mentioned previously.

In the illustrated embodiment, the cartridge is shown as having a generally flat bottom wall 18; however, in an alternative embodiment (not shown), to secure more effective emptying of the cartridge before spraying has to be discontinued, the bottom wall may be of inwardly concave configuration with the lowest point located beneath the capillary structure. Also whilst in the embodiment of FIG. 1 the interior of the container is partitioned by means of a tubular partition, it will be understood that the partitioning may take other forms such that a pressure differential is developed between two chambers which serves to maintain the liquid level around the capillary tube at a substantially constant position despite variation in the amount of liquid within the container.

Whilst the upper end of the capillary structure 22 may be cut square as disclosed in EP-A-486198, improved dispersal of the spray into the surroundings can be achieved by providing the capillary structure with an oblique end face as shown in FIG. 1 so as to favour spraying from one side thereof.

Figure 2:
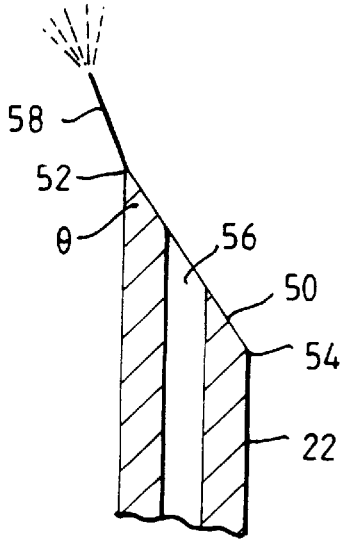
FIGS. 2 and 3 are schematic views showing different spraying tip configurations.

Referring to FIG. 2, the upper end of the tube 22 is cut obliquely so that the end face 50 thereof extends in a plane which intersects the outer peripheral surface of the tube at different axial locations thereby forming a leading extremity 52 which is acute-angled. At the diametrically opposite location, a trailing extremity 54 is formed which is obtuse-angled. In this manner, the electric field is intensified in the vicinity of the leading extremity thereby favouring spraying from this location. Typically, the angle θ at the leading extremity is within the range 30 to 60° (eg 40 to 50°).

In operation, the liquid is drawn from the capillary bore 56 across the end face 50 towards the outer peripheral surface of the tube. Because of the intensified electric field prevailing in the vicinity of the leading extremity 52, the liquid is preferentially drawn into a number of ligaments from an edge portion in the locality of extremity 52 and thereafter breaks up into droplets to form the spray. In general, the ligaments issue from the edge at angles bisecting the surfaces flanking the site of ligament formation. It will be understood that by favouring ligament formation at one side of the tube by producing it with an asymmetric configuration, the ligaments can be projected at angles closer to the vertical, compared with configurations such as those described and illustrated in our prior EP-A-486198. A typical ligament is depicted by reference numeral 58. By producing ligaments which are projected from the spraying tip at angles closer to the vertical, more effective dispersal of the spray into the surrounding atmosphere can be secured with reduced tendency for the spray to be attracted towards, and deposit onto, the surface on which the device is located, especially when the latter surface is at earth potential (which will often be the case). The ligaments issuing from the region around the leading extremity may be aligned more closely with the vertical by varying the angle of inclination of the end face 50 and/or by tilting the tube 22 appropriately. In the latter case, it will be understood that the cartridge and/or device may be designed so as to impart the desired tilt to the tube when the cartridge is installed in the device.

The configuration of FIG. 2 is suitable where the capillary tube has a relatively thin wall. Many commercially available forms of capillary tube however tend to be relatively thick walled (typically in excess of 1 mm). If such tubes are employed, the distance between the tube bore and the outer periphery of the tube may be such that feed of liquid to the site at which ligament formation is desired becomes unreliable with consequent loss of spraying efficiency. To overcome this problem, the end face configuration of the capillary tube may be modified so that the leading extremity is inboard of the outer peripheral surface of the tube.

Figure 3:
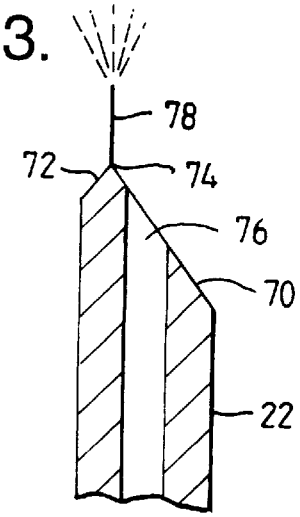

Thus, as shown in FIG. 3, the end face is defined by two planes 70 and 72 intersecting at a leading edge 74 at which ligament formation is favoured and which is inboard (except at its ends) of the peripheral surface of the tube 22. Thus, the distance between the capillary bore 76 and the edge 74 is for the most part less than the distance between bore and the outer peripheral surface of the tube. By configuring the tube end face in this way, it will also be seen that the line of projection of the ligaments may be aligned even more closely with the vertical, eg as indicated by the ligament 78, without tilting the tube.

Although not illustrated, a cap will normally be provided for the tube 22 for covering the end face thereof when the device is not in use, thereby preventing drying of the formulation on the end face, which could otherwise have a deleterious affect on spraying efficiency.

Figure 4:
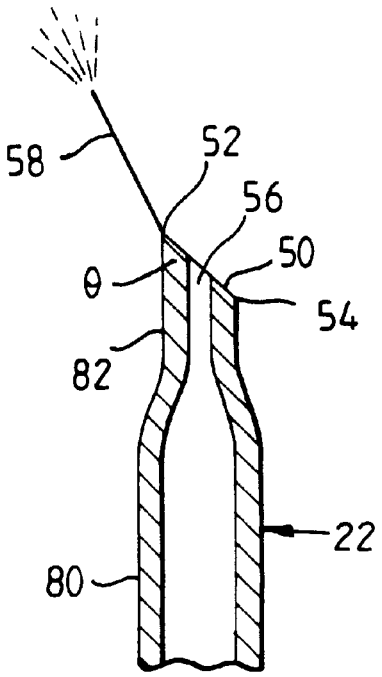
FIG. 4 and 5 are schematic views showing further alternative spraying tip configurations.
Figure 5:
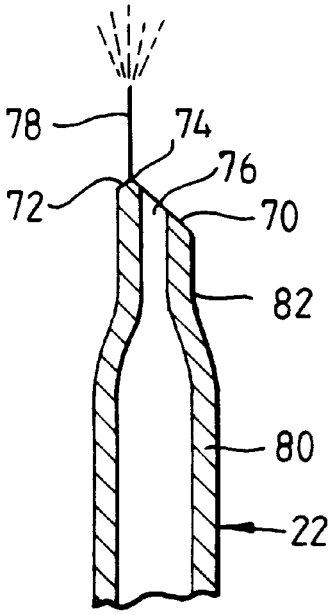

The capillary tube 22 may be further modified in order to improve liquid delivery to the spraying tip. Referring to FIGS. 4 and 5 (in which the same reference numerals are used to depict parts in common with FIGS. 2 and 3 respectively), the capillary tube 22 comprises two portions, a first portion 80 of larger bore section which extends into the interior of the cartridge and a second portion 82 of smaller bore section which forms the upper end of the capillary tube and terminates in the spraying tip. The larger diameter bore 80 serves to provide a relatively high delivery rate (compared with that which could be provided by a capillary tube having the same bore section as the portion 82 over its entire length) whilst the smaller diameter capillary portion 82 serves to intensify the electric field in the vicinity of the spraying tip while acting as a throttle to control liquid flow to the spraying tip. By appropriate selection of the length and diameter of the capillary portion 82, the electric field intensification and the liquid delivery rate can be fine tuned to achieve optimum spraying for a given application.

In addition, it is advantageous if the spraying tip of the tube is configured so as to favour spraying from one side thereof in the manner and for the purpose described with reference to FIGS. 2 and 3. For instance, as shown in FIG. 4, the upper end of the tube portion 82 is cut obliquely so that the end face 50 thereof extends in a plane which intersects the outer peripheral surface of the tube at different axial locations thereby forming a leading extremity 52 which is acute-angled. At the diametrically opposite location, a trailing extremity 54 is formed which is obtuse-angled. In this manner, the electric field can be further intensified in the vicinity of the leading extremity thereby favouring spraying from this location.

We claim:

1. A cartridge for use in electrostatic spraying comprising a container for liquid to be electrostatically sprayed, a capillary feed structure having one end thereof located within the container and an opposite end thereof forming or associated with a spraying tip of the device in use, and means within the container for controlling liquid level within the container, in which the base of the cartridge is of inwardly concave configuration with the lowest point located beneath the capillary structure.

2. In or for an electrostatic spraying device, a cartridge comprising a container containing a liquid to be sprayed, said liquid having a bulk resistivity within the range from about $10^4$ to about $5\times10^7$ ohm cm and a capillary tube of non-metallic material having one end thereof located within the container and an opposite end thereof forming a spraying tip of the device in use, said opposite end of the capillary tube being of asymmetric configuration such that spraying of liquid from one side of the tube is favoured, said capillary tube having a first capillary portion extending from one end followed by a second capillary portion terminating at or adjacent the opposite end of the capillary tube, the second portion having a bore of smaller cross-sectional area than that of the first portion.

3. An electrostatic spraying device comprising a spraying tip, a reservoir for containing liquid to be supplied to the spraying tip, a capillary tube having one end thereof located within the reservoir and the other end thereof forming the spraying tip, and means for applying high voltage to the liquid so that liquid discharged from the spraying tip is atomised under the influence of the electric field, the capillary tube, the reservoir and the voltage applying means being embodied in a housing which is adapted for stable location in a position in which the capillary tube points upwardly and feed of liquid from the reservoir to the spraying tip is provided by capillary action, characterised in that the capillary tube comprises a first capillary portion extending from said one end followed by a second capillary portion terminating at or adjacent said opposite end of the capillary tube, the second portion having a bore of smaller cross-sectional area than that of the first portion.

4. A cartridge for use in an electrostatic spraying device comprising a container containing a liquid to be electrostatically sprayed, a capillary tube extending from a location immediately adjacent one end of the container, through an opening at the opposite end of the container and terminating in a spraying tip to which said liquid is transported by capillary action, the capillary tube comprising a first capillary portion extending from said one end followed by a second capillary portion at or adjacent said spraying tip, the second portion having a bore of smaller cross-sectional area than that of the first portion.

5. A cartridge or device as claimed in claim 4 in which the first portion of the capillary tube has an outside diameter of 400 to 800 microns.

6. A cartridge or device as claimed in any one of claims 4 in which the first portion of the capillary tube has an inside diameter of 200 to 300 microns.

7. A cartridge or device as claimed in claim 4 in which the second capillary portion has an outside diameter of 200 to 400 microns.

8. A cartridge or device as claimed in claim 4 in which the second capillary portion has an inside diameter of 50 to 100 microns.

9. A cartridge or device as claimed in claim 4 in which the capillary structure comprises a capillary tube the wall thickness of which at the tip is no greater than 400 microns.

10. A cartridge or device as claimed in claim 9 in which the wall thickness of which at the tip is no greater than about 250–300 microns.

11. A cartridge or device as claimed in claim 9 in which the wall thickness of the tube at the tip is no greater than about 100–150 microns.

* * * * *